US005465022A

United States Patent [19]

Katoh et al.

[11] Patent Number: 5,465,022

[45] Date of Patent: Nov. 7, 1995

[54] SPARK PLUG FOR INTERNAL-COMBUSTION ENGINE AND MANUFACTURE METHOD OF THE SAME

[75] Inventors: Akio Katoh, Nishio; Nobuo Abe, Yokkaichi; Takeshi Hanai, Kuwana; Kenji Horibe, Aichi, all of Japan

[73] Assignee: Nippondenso Co., Ltd., Kariya, Japan

[21] Appl. No.: 104,203

[22] Filed: Aug. 11, 1993

[30] Foreign Application Priority Data

| | | | |
|---|---|---|---|
| Aug. 12, 1992 | [JP] | Japan | 4-236548 |
| Sep. 1, 1992 | [JP] | Japan | 4-257342 |
| Sep. 25, 1992 | [JP] | Japan | 4-256461 |

[51] Int. Cl.[6] ..... H01T 13/20; H01T 13/32

[52] U.S. Cl. ..... 313/144; 313/144; 313/142

[58] Field of Search ..... 313/141, 142, 313/144; 123/169 EL

[56] References Cited

U.S. PATENT DOCUMENTS

| | | | |
|---|---|---|---|
| 3,673,452 | 6/1972 | Brennen | 313/141 |
| 3,868,530 | 2/1975 | Eaton et al. | 313/141 |
| 4,122,366 | 10/1978 | Von Stutterheim et al. | 313/142 X |
| 4,540,910 | 9/1985 | Kondo et al. | 313/141 X |
| 4,581,558 | 4/1986 | Takamura et al. | 313/141 |
| 4,670,684 | 6/1987 | Kagawa et al. | 313/141 |
| 4,853,582 | 8/1989 | Sato et al. | 313/141 |

FOREIGN PATENT DOCUMENTS

| | | |
|---|---|---|
| 3313803 | 2/1957 | Japan . |
| 6-262374 | 12/1985 | Japan . |
| 322033 | 3/1991 | Japan . |

*Primary Examiner*—Sandra L. O'Shea
*Assistant Examiner*—Ashok Patel
*Attorney, Agent, or Firm*—Cushman, Darby & Cushman

[57] ABSTRACT

A composite chip formed by joining a discharging layer and a heat stress relieving layer at a joint interface therebetween beforehand is provided on at least one of a central electrode and a ground electrode in its discharge portion made of an electrode material. The discharging layer is made of a precious metal or a precious metal alloy having superior spark- and wear-resistance, and the heat stress relieving layer is made of a metal or an alloy having a linear expansion coefficient between those of the discharging layer and the electrode material. Formed at the joint interface between both the discharging layer and the heat stress relieving layer through mutual diffusion of those materials developed when the two layers are joined to each other is a diffusion layer, in which concentrations of materials of both the layers are continuously changed. A thickness of the diffusion layer is not less than 3 μm in a state that the composite chip is welded to the discharge portion.

9 Claims, 9 Drawing Sheets

SPARK PLUG FOR INTERNAL-COMBUSTION ENGINE AND MANUFACTURE METHOD OF THE SAME

BACKGROUND OF THE INVENTION

The present invention relates to a spark plug for use in internal-combustion engines in which a composite chip comprising a discharging layer and a thermal stress relieving layer is disposed in the discharge portion of an electrode, and a manufacture method of the spark plug for use in internal-combustion engines which is improved to enhance heat resistance and durability of the composite chip.

Engines of automobiles and the like include spark plugs of the type that a precious metal such as Pt (platinum) or a Pt alloy is disposed in discharge portions of the spark plug. This type spark plug can be used for a long period of time in maintenance-free fashion because such a precious metal is disposed in the discharging portions which are most severely worn.

Meanwhile, from the standpoint of environmental protection aiming to reduce fuel consumption and conform with exhaust gas regulations, there is a tendency in engines to increase the compression ratio and achieve leaner burning. This tendency means that the temperature in a combustion chamber of the engine is raised. In the discharge portions of the spark plug, therefore, the thermal stress becomes larger which is attributable to a difference in linear expansion coefficient between the previous metal and an electrode material of the discharge portions.

In view of the above, as disclosed in Japanese Patent Publication No. 3-22033 and Japanese Patent Unexamined Publication No. 60-262374, it has been proposed to employ a composite chip comprising a heat stress relieving layer and a discharging layer. The composite chip is welded to the discharge portion of an electrode with the heat stress relieving layer facing the discharge portion. The heat stress relieving layer has a linear expansion coefficient between coefficients of the discharging layer and the discharge portion.

Recently, however, there has been a demand for higher performance of spark plugs. This demand has increased more and more the thermal load imposed on spark plugs.

As a result, there may occur oxidation corrosion due to the heat stress at the joint interface between the discharging layer and the heat stress relieving layer which have been joined beforehand, or falling-off of the discharging layer in the extreme case, making spark plugs not durable for a long period of time.

Furthermore, if resistance welding is performed under energizing conditions suitable to provide a sufficient degree of adhesion at the joint interface when joining the composite chip to an electrode material, the heat stress relieving layer is melted, by the Joule heat generated at the joint interface between the heat stress relieving layer of the composite chip and the electrode material, to spread out as a linear burr along its outer periphery. Consequently, the heat stress relieving layer is thinned remarkably.

In addition, at the time of welding the composite chip to the discharge portion, it is required to discriminate which side of the composite chip is the discharging layer or the heat stress relieving layer.

However, the conventional composite chip has a thickness of about 0.3 to 0.7 mm and, in many cases, both the layers thereof have almost the same thickness. This makes it difficult to discriminate the discharging layer and the heat stress relieving layer from each other.

With the foregoing in mind, there has been proposed another prior art that a composite chip in the discharging layer and the heat stress relieving layer which are different in edge size, or a composite chip which is marked such as by coloring the bottom surface at either one side, is welded to the discharge portion of the spark plug (see Japanese Patent Unexamined Publication No. 60-262374).

Provision of a difference in edge size between the discharging layer and the heat stress relieving layer, however, is very difficult in a step of punching the composite chip. Accordingly, a step of providing such a difference in edge size is added separately from the step of punching the composite chip. This leads to an unreliable result because of a fear that the difference in edge size may be provided reversely by mistake.

Moreover, the addition of the new step increases the production cost. In the case of marking the composite chip by such as coloring either one side thereof, the production cost is also increased owing to the addition of a new step.

SUMMARY OF THE INVENTION

An object of the present invention is to provide a spark plug for use in internal-combustion engines which can prevent peeling-off and falling-off of a discharging layer.

Another object of the present invention is to provide a method of manufacturing a spark plug for use in internal-combustion engines by which the front and rear sides of a composite chip can be surely discriminated, and which is inexpensive.

A still another object of the present invention is to provide a method of manufacturing a spark plug for use in internal-combustion engines by which a heat stress relieving layer can be attached with a sufficiently strong adhesion to an electrode and can be prevented from deformation.

To achieve the above objects, according to the present invention, there is provided a discharge electrode assembly comprising;

a base, and a composite chip joined to said base and comprising a spark- and wear-resistant discharging layer having higher heat resistance and wear resistance than said base and having a linear expansion coefficient different from that of said base, and a heat stress relieving layer, said discharging layer and said heat stress relieving layer being joined together into a one-piece laminated structure beforehand through an alloy layer consisting of materials of both said layers, said heat stress relieving layer of said composite chip being joined to said base, said alloy layer having a thickness of at least about 3 μm.

According to one aspect of the present invention, there is provided a spark plug including:

first and second electrodes opposing to each other, and a composite chip comprising a spark- and wear-resistant discharging layer and a heat stress relieving layer, which layers are joined together into a one-piece superposed structure beforehand, said heat stress relieving layer of said composite chip being joined to at least one of said first and second electrodes, wherein an alloy layer is formed at the joint interface between said discharging layer and said heat stress relieving layer of said composite chip, and is effective to achieve joint between said discharging layer and said heat stress relieving layer, said alloy layer having a thickness of at least about 3 μm.

According to another aspect of the present invention, there is provided a spark plug including:

a central electrode, a ground electrode, and a composite chip joined to at least one of said central electrode and said ground electrode, and comprising a spark- and wear-resistant discharging layer and a heat stress relieving layer, which layers are joined together into a one-piece superposed structure beforehand, said heat stress relieving layer of said composite chip being joined to at least one of said central electrode and said ground electrode, wherein an alloy layer is formed at the joint interface between said discharging layer and said heat stress relieving layer of said composite chip, and is effective to achieve the positive joint between said discharging layer and said heat stress relieving layer, said alloy layer having a thickness of at least about 3 μm.

According to still another aspect of the present invention, there is provided a method of manufacturing a discharge electrode assembly, comprising the steps of;

superposing a highly heat- and wear-resistant discharging layer and a heat stress relieving layer one above the other, holding both said layers under a predetermined atmosphere for a predetermined period of time while applying heat and pressure to the interface of said superposed layers, and forming, between both said layers, an alloy layer in which concentrations of materials of both said layers are continuously changed and which has a thickness of at least about 3 μm, thereby preparing a composite chip comprising said discharging layer and said heat stress relieving layer joined together through said alloy layer, and joining said composite chip to a base with said heat stress relieving layer facing said base.

According to a yet other aspect of the present invention, there is provided a method of manufacturing a spark plug, comprising the steps of;

superposing a highly heat- and wear-resistant discharging layer and a heat stress relieving layer one above the other, holding both said layers under a predetermined atmosphere for a predetermined period of time while applying heat and pressure to the interface of said superposed layers, and forming, between both said layers, an alloy layer in which concentrations of materials of both said layers are continuously changed and which has a thickness of at least about 3 μm, thereby preparing a composite chip comprising said discharging layer and said heat stress relieving layer joined together through said alloy layer, and joining said composite chip to at least one of first and second electrodes.

DESCRIPTION OF THE PREFERRED EMBODIMENTS

A first embodiment of the present invention will be described with reference to FIGS. 1 to 5.

Figure 1:
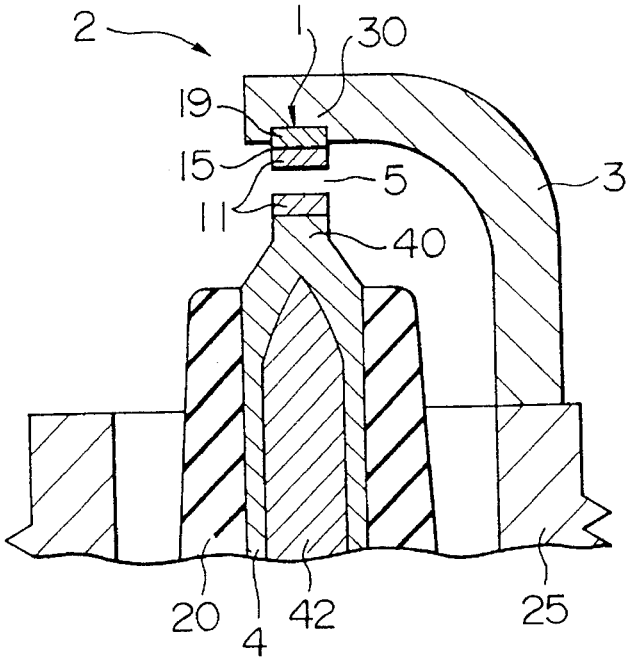
FIG. 1 is an enlarged sectional view of an essential part of a spark plug according to a first embodiment of the present invention.
Figure 2:
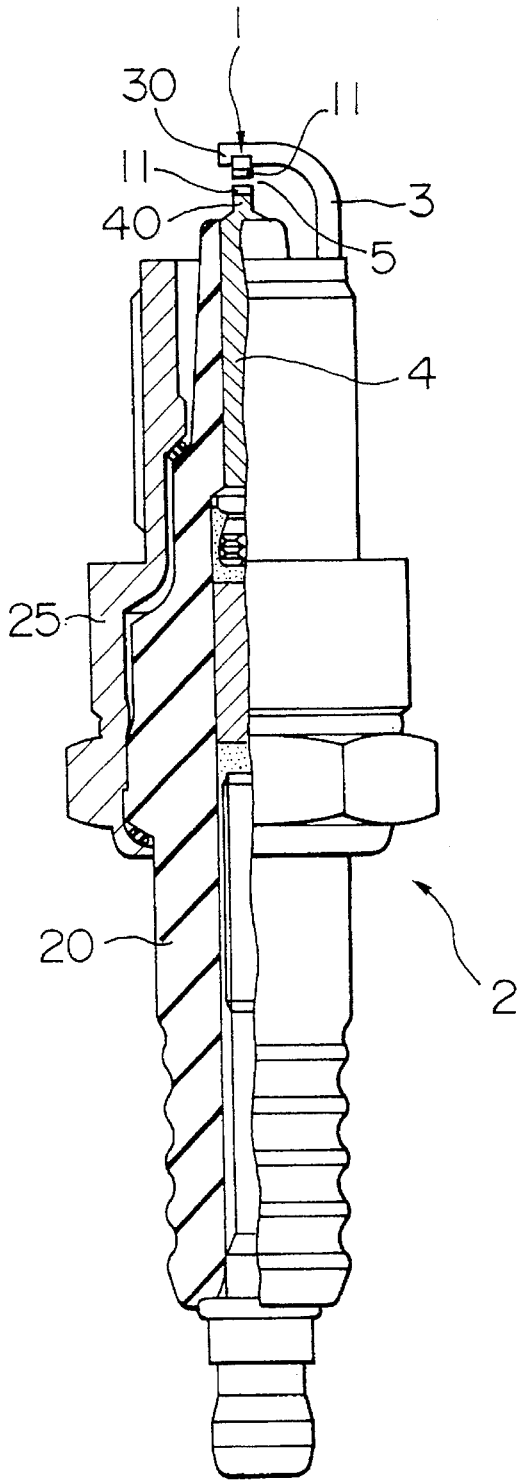
FIG. 2 is a partly-sectioned side view of the spark plug according to the first embodiment.

A spark plug 2 for use in internal-combustion engines according to this embodiment comprises, as shown in FIGS. 1 and 2, an insulator 20, a central electrode 4 held by the insulator 20, a housing 25 fixedly provided about the insulator 20, and a ground electrode 3 attached to the housing 25 in opposing relation to the central electrode 4 with a spark discharge gap 5 therebetween.

Discharge portions 30, 40 are provided at respective tip ends of the ground electrode 3 and the central electrode 4.

Figure 3A:
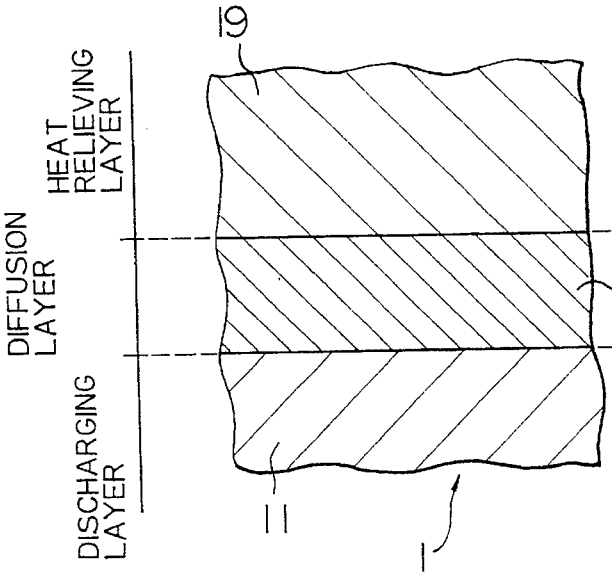
FIG. 3A is an enlarged sectional view of an essential part of a composite chip according to the first embodiment.

A composite chip 1 is provided on the discharge portion 30. The composite chip 1 is formed by, as shown in FIG. 3A, joining a discharging layer 11 and a heat stress relieving layer 19 to each other at the joint interface beforehand. It is to be noted that FIG. 3A shows the condition after diffusion; hence the initial joint interface is not shown.

Figure 3B:
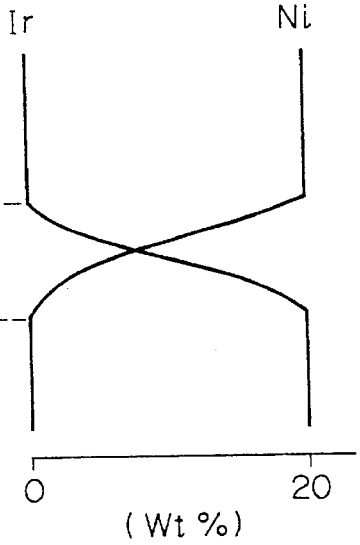
FIG. 3B is a graph showing distribution of Ni—Ir composition in the composite chip according the first embodiment.

An alloy layer such as a diffusion layer 15 is formed between the discharging layer 11 and the heat stress relieving layer 19. The diffusion layer 15 is formed by mutual diffusion of both materials developed when the discharging layer 11 and the heat stress relieving layer 19 are joined to each other. As shown in FIG. 3B, contents of both the materials are continuously changed in the diffusion layer 15.

A thickness of the diffusion layer 15 is 3 μm in a state that the composite chip 1 is welded to the discharge portion 30.

The discharging layer 11 is made of a Pt—Ir alloy consisting of 80 wt % Pt and 20 wt % Ir (iridium), as a precious metal alloy which has superior spark- and wear-resistance. A linear expansion coefficient of the discharging layer 11 is $9\times10^{-6}$/°C.

The discharge portion 30 of the ground electrode 3 is made of an Ni-base heat-resistant alloy and has a linear expansion coefficient of $15\times10^{-6}$/°C.

The heat stress relieving layer 19 is made of a Pt—Ni alloy consisting of 80 wt % Pt and 20 wt % Ni (nickel). A linear expansion coefficient of the heat stress relieving layer 19 is $12\times10^{-6}$/°C. These values of the linear expansion coefficient are ones measured at temperature between 50° C. and 800° C.

The ground electrode 3 is extended from the housing 25 in the cantilevered form.

The central electrode 4 and the ground electrode 3 are each made of an electrode material comprising an Ni-base heat-resistant alloy. Also, to improve thermal conductivity of the central electrode 4, a Cu material 42 is enclosed in the central electrode 4.

The discharging layer 11 and the heat stress relieving layer 19 are joined to each other as follows. Both the layers 11, 19 are superposed one above the other and subjected to heat treatment at about 1000° C. for about 1 hour under a vacuum less than $10^{-3}$ torr or a non-oxidizing atmosphere such as Ar gas while being pressed. The diffusion layer 15 is thereby formed between the discharging layer 11 and the heat stress relieving layer 19.

Thicknesses of the composite chip 1, the discharging layer 11, the diffusion layer 15, and the heat stress relieving layer 19 are respectively 0.5 mm, 0.35 mm, 4.2 μm and 0.15 mm before the composite chip 1 is welded to the discharge portion 30. After the welding, those thicknesses of the composite chip 1, the discharging layer 11, the diffusion layer 15, and the heat stress relieving layer 19 were reduced to 70% of the values before the welding.

Operating advantages of this embodiment will be described below.

In this embodiment, formed between the discharging layer 11 and the heat stress relieving layer 19 is an alloy layer such as the diffusion layer 15, in which the contents of their materials are continuously changed, through mutual diffusion of those materials developed when the two layers 11, 19 are joined to each other. The diffusion layer 15 has a thickness of 3 μm in a state that the composite chip 1 is welded to the discharge portion 30.

Therefore, the materials of the discharging layer 11 and the heat stress relieving layer 19 are gradually changed in the diffusion layer 15. More specifically, the material of the discharging layer 11 is continuously reduced in its content from the side of the discharging layer 11 toward the side of the heat stress relieving layer 19 in the diffusion layer 15. On the other hand, the material of the heat stress relieving layer 19 is continuously reduced in its content from the side of the heat stress relieving layer 19 toward the side of the discharging layer 11 in the diffusion layer 15.

Accordingly, the difference in linear expansion coefficient between both the materials is also gradually changed in the diffusion layer 15. This is effective to relieve the heat stress imposed on both the materials in the diffusion layer 15 when the composite chip 1 is subjected to the load due to repetition of low and high temperatures, thereby preventing the occurrence of cracking and stress corrosion. As a result, a service life of the spark plug 2 is prolonged to enable its use for a long period of time.

Then, for the spark plug of this embodiment, an evaluation test was made on resistance of the diffusion layer against oxidizing corrosion due to spark discharge while varying the thickness of the diffusion layer.

The thickness of the diffusion layer was changed by changing heating conditions set at the time of joining the discharging layer and the heat stress relieving layer to each other.

The above test was conducted by mounting the spark plug on a 2000 cc, water-cooled, four-cycle six-cylinder automobile engine and having the same subjected to a load of low and high temperatures during 100 hours such that the engine ran at 6,000 rpm for one minute with its throttle fully opened and then idled for one minute following. The results are shown in FIG. 5.

Figure 4:
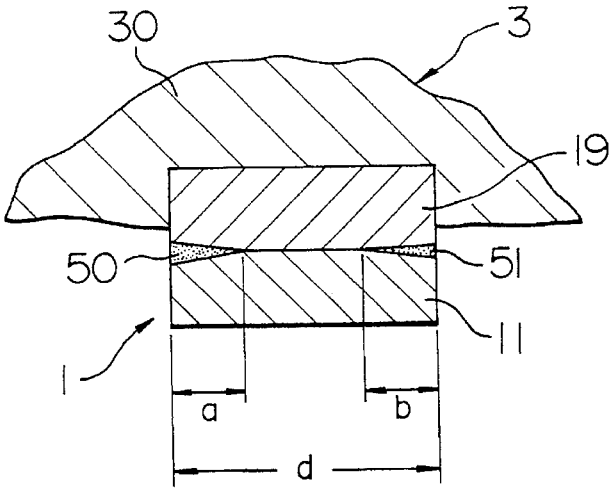
FIG. 4 is an explanatory view for explaining a method of calculating a rate of oxidation corrosion in the first embodiment.
Figure 5:
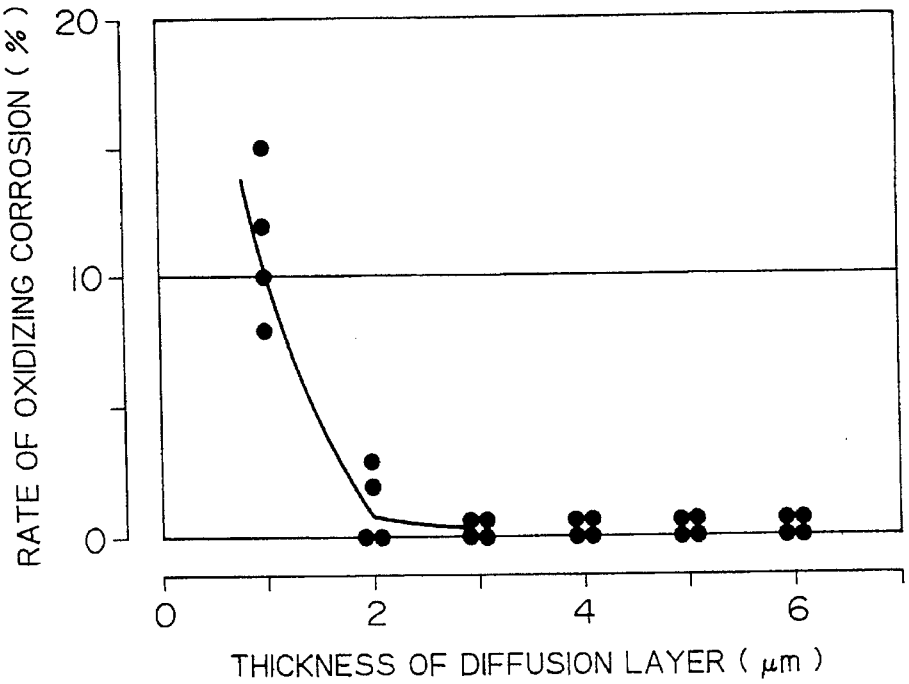
FIG. 5 is a graph showing the relationship between the thickness of a diffusion layer and the rate of oxidation corrosion in the first embodiment.

In FIG. 5, the abscissa represents the thickness of the diffusion layer in a state that the composite chip is welded to the discharge portion, and the ordinate represents the rate of oxidizing corrosion between the discharging layer and the heat stress relieving layer. The rate of oxidizing corrosion was calculated on the basis of a formula of $(a+b)\times100/d$ where radial lengths of oxidizing corrosion portions 50, 51 and the composite chip 1 are respectively a, b and c, as shown in FIG. 4.

As will be seen from FIG. 5, there occurred no oxidizing corrosion if the thickness of the diffusion layer was not less than 3 μm. On the other hand, there occurred oxidizing corrosion if the thickness of the diffusion layer was less than 3 μm.

It is found from the above results that the diffusion layer in this embodiment exhibits a superior effect in improving resistance against oxidizing corrosion.

A spark plug according to a second embodiment comprises a heat stress relieving layer made of a Pt—Ni alloy which consists of 60 wt % Pt and 40 wt % Ni or 90 wt % Pt and 10 wt % Ni, and a discharging layer made of a Pt—Ir alloy which consists of 100 wt % Pt or 70 wt % Pt and 30 wt % Ir.

The other construction is similar to that of the first embodiment.

For the spark plug of this second embodiment, an evaluation test was also made on resistance of the diffusion layer against oxidizing corrosion due to spark discharge while varying combinations of the above compositions of the discharging layer and the heat stress relieving layer, as with the first embodiment. As a consequence, the results similar to those of the first embodiment were obtained.

Figure 6:
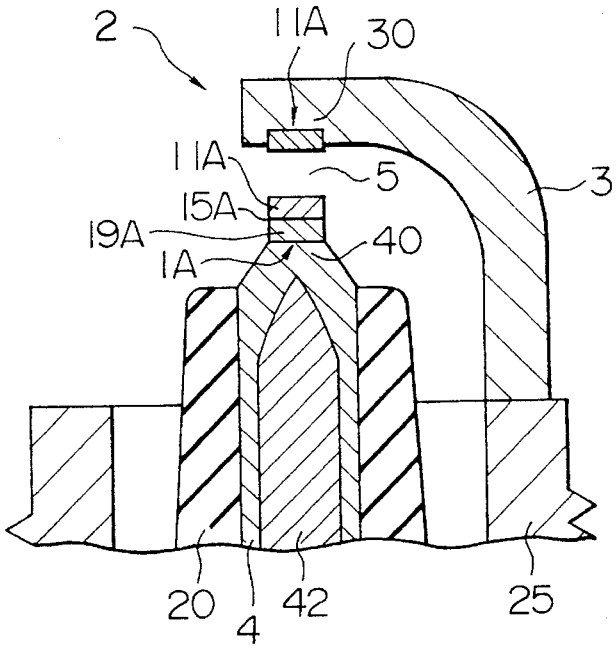
FIG. 6 is an enlarged sectional view of an essential part of a spark plug according to a third embodiment of the present invention.

In a spark plug according to a third embodiment of the present invention, as shown in FIG. 6, a composite chip 1A is provided on the discharge portion 40 of the central electrode 4, while a discharging layer 11A is provided on the discharge portion 30 of the ground electrode 3. The other construction is similar to that of the first embodiment.

With this embodiment, the advantages similar to those of the first embodiment can also be obtained.

Figure 7:
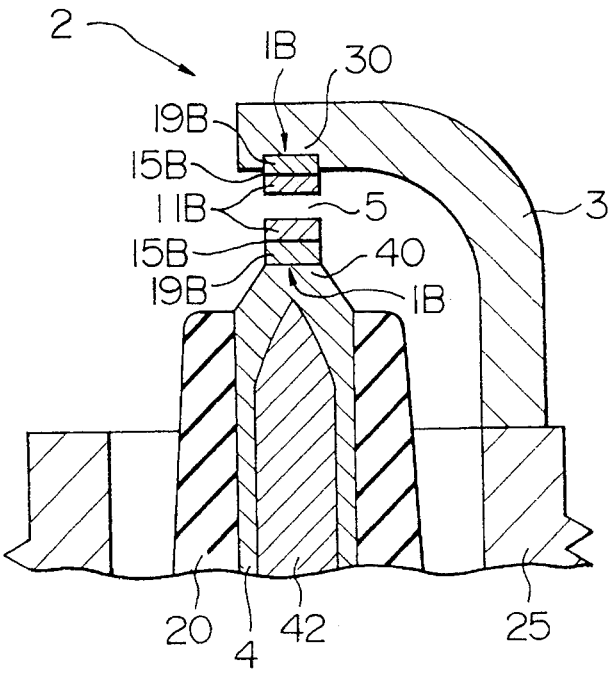
FIG. 7 is a partly-sectioned side view of a spark plug according to a fourth embodiment of the present invention.

In a spark plug according to a fourth embodiment of the present invention, as shown in FIG. 7, composite chips 1B are provided on the discharge portions 30, 40 of the ground electrode 3 and the central electrode 4. The other construction is similar to that of the first embodiment.

With this embodiment, the advantages similar to those of the first embodiment can also be obtained.

The most essential point to be noted in the present invention is that formed at the joint interface between the discharging layer and the heat stress relieving layer is the diffusion layer, in which the contents of their materials are continuously changed, through mutual diffusion of those materials developed when the two layers are welded to each other, and that the diffusion layer has a thickness of not less than 3 μm in a state that the composite chip is welded to the discharge portion.

If the thickness of the diffusion layer is less than 3 μm, the heat stress in both the materials is insufficiently reduced and oxidizing corrosion occurs in the diffusion layer. In the extreme case, there is a fear that the discharging layer may fall off from the heat stress relieving layer.

The thickness of the diffusion layer is set depending on the heating conditions in manufacture of the composite chip. Thus, the thickness of the diffusion layer can be increased by raising the heating temperature or lengthening the heating time.

If base metals such as Ni and Fe are contained as ingredients of the composite chip, the composite chip is heated under a vacuum or a non-oxidizing atmosphere such as $N_2$ gas, Ar gas or $N_2+H_2$ gas while being pressed. When the composite chip thus treated is welded to the discharge portion, it is deformed and reduced in thickness due to the pressing force and the Joule heat. Therefore, the heating conditions are required to be set in anticipation of such a reduction in the thickness.

Accordingly, the thickness of the diffusion layer before the welding to the discharge portion is preferably set to be 1.4 times that of the diffusion layer after the welding.

It is preferable that the discharging layer is made of a Pt—Ir alloy consisting of 70 to 100 wt % Pt and 0 to 30 wt % Ir, and the heat stress relieving layer is made of a Pt—Ni alloy consisting of 60 to 90 wt % Pt and 10 to 40 wt % Ni.

If the composition of the Pt—Ir alloy in the discharging layer is out of the above range, the wear of the discharging layer is so increased that the period of time in which the spark plug is usable may be shortened.

Also, if the composition of the Pt—Ni alloy is out of the above range, the linear expansion coefficient of the heat stress relieving layer becomes too far from that of the discharging layer or the electrode material. This results in a fear that, when subjected to the load due to repetition of low and high temperatures, the heat stress relieving layer may not sufficiently relieve the heat stress in the discharging layer and the electrode material, thereby causing cracking and stress corrosion therein.

A fifth embodiment of the present invention will be described with reference to FIGS. 8 to 10.

Figure 10:
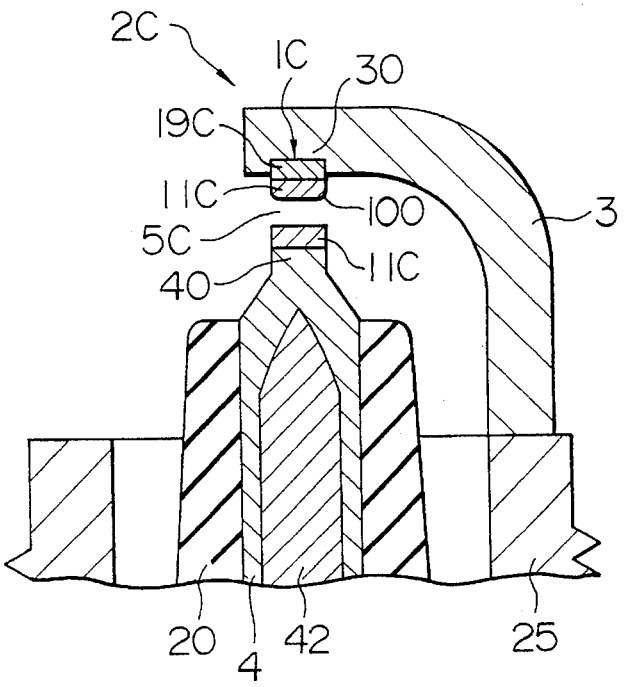
FIG. 10 is an enlarged sectional view of an essential part of a spark plug for use in internal-combustion engines according to the fifth embodiment.

A spark plug 2C for use in internal-combustion engines according to this embodiment comprises, as shown in FIG. 10, an insulator 20, a central electrode 4 held by the insulator 20, a housing 25 fixedly provided about the insulator 20, and a ground electrode 3 attached to the housing 25 in opposing relation to the central electrode 4 with a spark discharge gap 5 therebetween.

Discharge portions 30, 40 are provided at respective tip ends of the ground electrode 3 and the central electrode 4, respectively.

Figure 9:
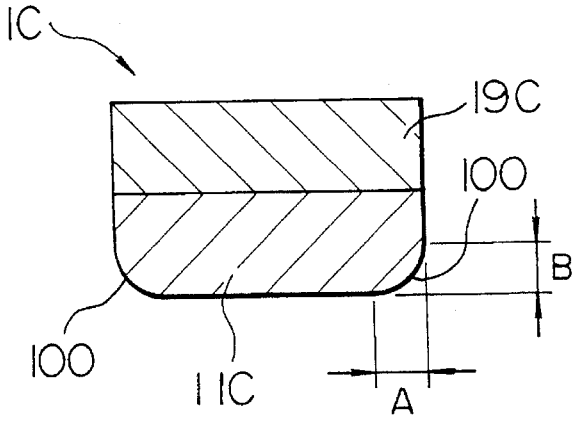
FIG. 9 is a sectional view of a composite chip according to the fifth embodiment.

Welded to the discharge portion 30 is, as shown in FIGS. 9 and 10, a composite chip 1C which comprises a discharging layer 11C and a heat stress relieving layer 19C joined to each other and has a discrimination mark 100.

The composite chip 1C is 1 mm in diameter and 0.5 mm thick.

The discharging layer 11C is made of an alloy of 80 wt % Pt–20 wt % Ir which has a thickness of 0.35 mm and a linear expansion coefficient of $9\times10^{-6}$/°C. The heat stress relieving layer 19C is made of an alloy of 80 wt % Pt–20 wt % Ni which has a thickness of 0.15 mm and a linear expansion coefficient of $12\times10^{-6}$/°C. The ground electrode 3 and the central electrode 4, respectively, are made of an electrode material comprising an Ni-base heat-resistant alloy which has a linear expansion coefficient of $15\times10^{-6}$/°C.

The composite chip 1C is provided on the discharge portion 30 and the discharging layer 11C is provided on the discharge portion 40, respectively.

The ground electrode 3 is extended from the housing 25 in a cantilevered fashion.

Also, in order to improve thermal conductivity of the central electrode 4, a Cu material 42 is enclosed in the central electrode 4.

A manufacturing method of the spark plug for use in internal-combustion engines according to this embodiment will now be described.

In a first step, as shown in FIG. 9, the composite chip 1C is prepared by joining the discharging layer 11C and the heat stress relieving layer 19C to each other, and applying a surface irregularity such as a the discrimination mark 100 thereto. The discrimination mark 100 comprises an arc-shaped or rounded corner formed along a peripheral edge of the discharging layer 11C. The rounded corner has a width A of 0.3 mm and a height B of 0.1 mm.

Figure 8:
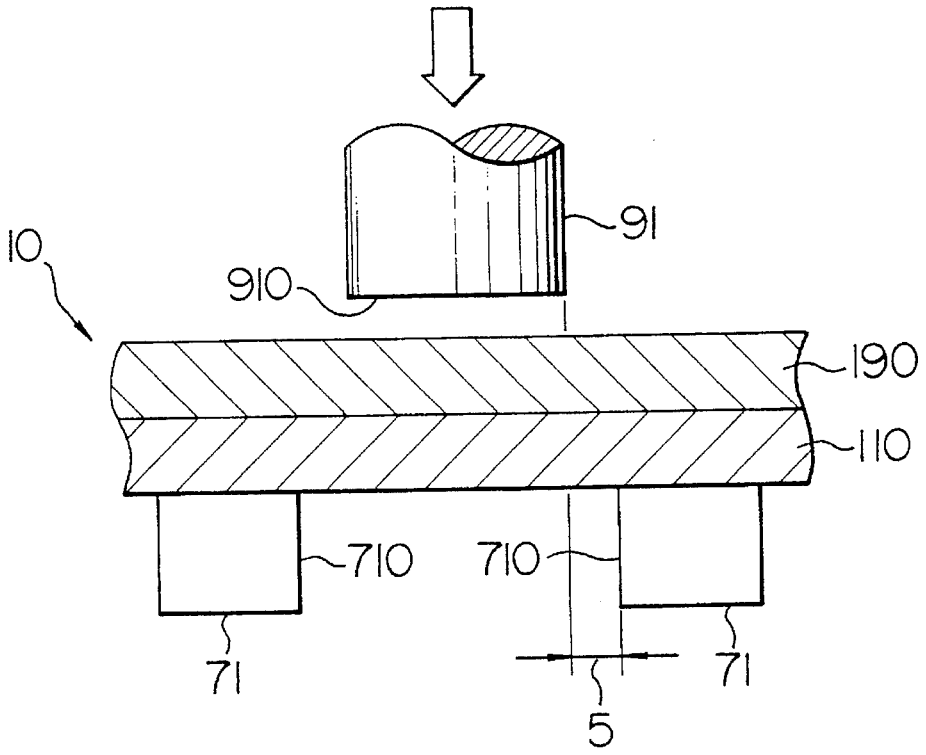
FIG. 8 is an explanatory view showing a manufacturing method according to a fifth embodiment of the present invention.

More specifically, as shown in FIG. 8, a sheet material 110 for the discharging layer and a sheet material 190 for the heat stress relieving layer are joined to each other to provide a composite sheet material 10.

Then, the composite sheet material 10 is rolled by means of rollers.

Next, the composite sheet material 10 is placed on a die 71 having an opening 710 which is of the same shape as the composite chip to be produced, and a punch 91 is placed on the composite sheet material 10, the punch 91 having a punching surface 910 which is smaller than the composite chip by a clearance 5. After that, the punch 91 is pressed against the sheet material 190 for the heat stress relieving layer of the composite sheet material 10. The composite chip 1C is thereby punched and, at the same time, the arc-shaped discrimination mark (rounded corner) 100 is formed along the peripheral edge of the discharging layer 11C, as shown in FIG. 9. The width A and the height B of the rounded corner 100 are set depending on the clearance 5.

Subsequently, in a second step, the composite chip 1C is welded to the discharge portion 30 with the heat stress relieving layer 19C facing the discharge portion 30, while identifying the discrimination marks of the individual composite chips 1C by a vibratory ball feeder available from Shinko Electric Co., Ltd.

The vibratory ball feeder has a groove-shaped passage for inhibiting the passage of those composite chips which are oriented such that the relevant peripheral edge of the composite chip C is rectangularly angled, and allowing the passage of those composite chips which are oriented such that it is rounded.

The composite chip 1C is welded to the discharge portion 30 by resistance welding.

Operating advantages of this embodiment will be described below.

In this embodiment, since the discrimination mark 100 is formed on the side of the discharging layer 11C of the composite chip 1C, it is easily and surely possible to discriminate between the discharging layer 11C and the heat stress relieving layer 19C of the composite chip C.

Also, since the discrimination mark 100 can be formed in the same step as that of forming the composite chip 1C without increasing the number of steps.

Figure 11:
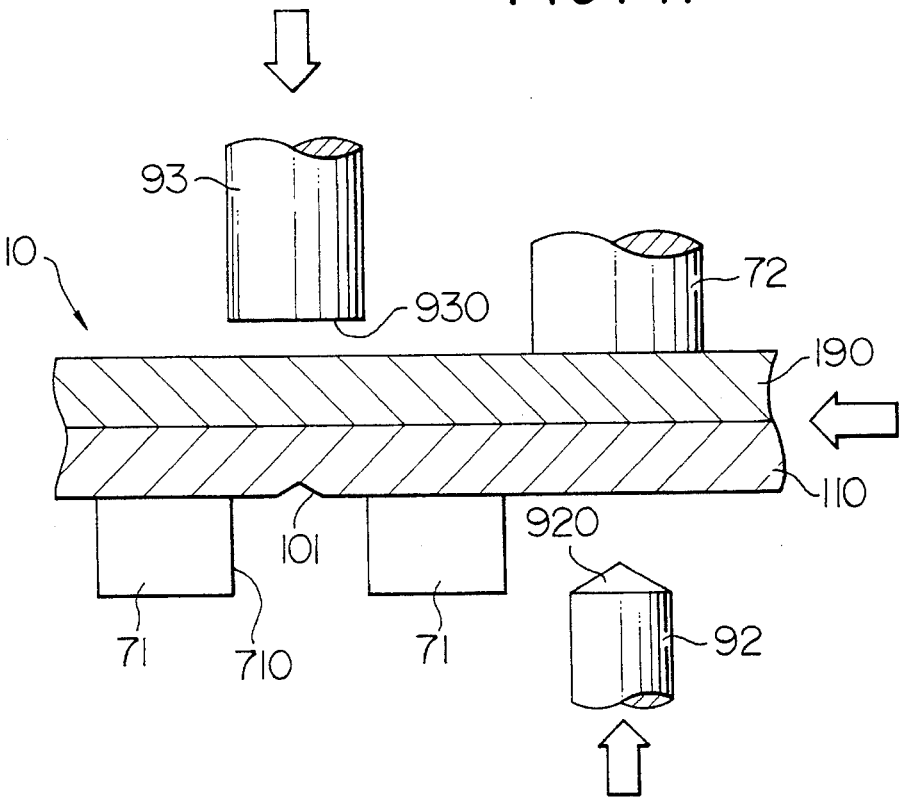
FIG. 11 is an explanatory view showing a manufacturing method according to a sixth embodiment of the present invention.
Figure 12A:
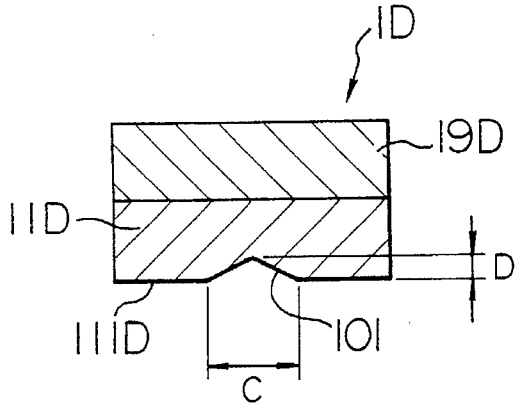
FIGS. 12A and FIG. 12B are a sectional view and a rear view of a composite chip, respectively, according to the sixth embodiment of the present invention.
Figure 12B:
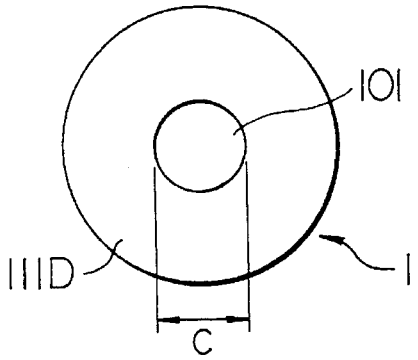

In a manufacturing method of a spark plug for use in internal-combustion engines according to a sixth embodiment of the present invention, as shown in FIGS. 11, 12A and 12B, a discrimination mark 101 comprises an indent in the conical shape and is formed at the center of a discharging surface 11D of a discharging layer 11D.

A manufacturing method of the spark plug according to this embodiment will now be described.

In a first step, a composite chip 1D is prepared by joining the discharging layer 11D and a heat stress relieving layer 19D to each other, and indenting the discrimination mark 101 thereon. The indent as the discrimination mark 101 has an opening width C of 0.3 mm and a depth D of 0.05 mm.

More specifically, as shown in FIG. 11, a sheet material 110 for the discharging layer and a sheet material 190 for the heat stress relieving layer are joined to each other and rolled to provide a composite sheet material 10.

Then, an indenting punch 92 having a tip end 920 which is of the same shape as the indent is placed on the side of the sheet material 110 for the discharging layer and a support 72 is placed on the side of the sheet material 190 for the heat stress relieving layer. Thereafter, while supporting the composite sheet material 10 by the support 72, the indenting punch 92 is pressed against the sheet material 110 for the discharging layer of the composite sheet material 10 to form the indent as the discrimination mark 101.

Next, a punch 93 having a punching surface 930 which is of the same shape as the composite chip to be produced is placed on the side of the sheet material 190 for the heat stress relieving layer, and a die 71 having an opening 710 which is of the same shape as the punching surface 930 is placed on the side of the sheet material 110 for the discharging layer. Subsequently, the punch 93 is pressed against the sheet material 190 for the heat stress relieving layer of the composite sheet material 10. The composite chip 1D comprising the discharging layer 11D and the heat stress relieving layer 19D and formed with the discrimination mark 101 is thereby punched out of the composite sheet material 10.

In the above step, the indenting punch 92 and the punch 93 are both driven by a single press. After the composite chip 1D has been punched out, the composite sheet material 10 is advanced successively so that the next composite chip is punched successively.

Thereafter, in a second step, the composite chip 1D is welded to the discharge portion 30 with the heat stress relieving layer 19D facing the discharge portion 30, while identifying the discrimination mark 101 of the composite chip 1D by an image recognizing device (see FIG. 10).

The other construction is similar to that of the fifth embodiment.

With this embodiment, the advantages similar to those of the fifth embodiment can also be obtained.

Figure 13A:
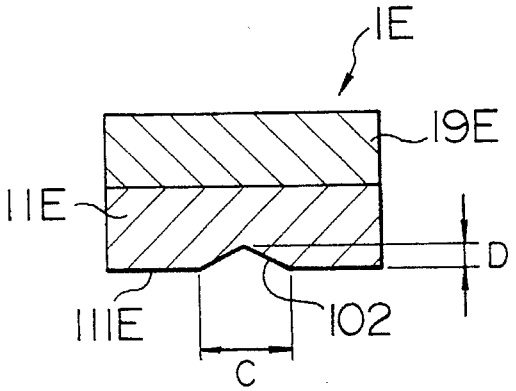
FIGS. 13A and FIG. 13B are a sectional view and a rear view of a composite chip, respectively, according to a seventh embodiment of the present invention.
Figure 13B:
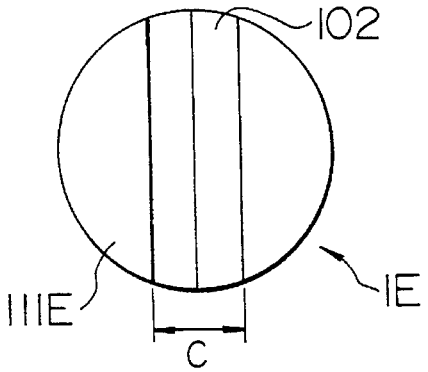

In a manufacturing method according to a seventh embodiment of the present invention, as shown in FIGS. 13A and 13B, a discrimination mark 102 comprises an indent in the form of a single groove. This single groove has an opening width C of 0.2 mm and a depth D of 0.05 mm. The other construction is similar to that of the sixth embodiment.

With this embodiment, the advantages similar to those of the fifth embodiment can also be obtained.

Figure 14A:
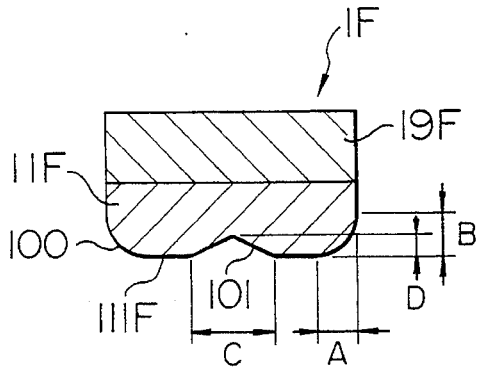
FIGS. 14A and FIG. 14B are a sectional view and a rear view of a composite chip, respectively, according to an eighth embodiment of the present invention.
Figure 14B:
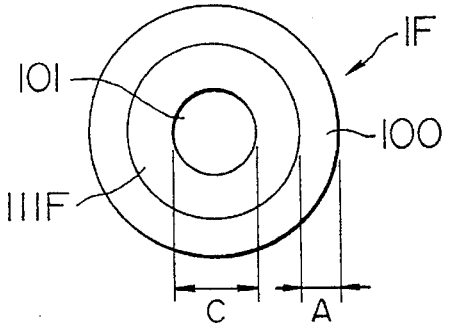

A composite chip 1F according to an eighth embodiment of the present invention is provided with, as shown in FIGS. 14A and 14B, a discrimination mark 100 in the form of a curved corner which is formed along the peripheral edge of the discharging layer 11F and has a width A and a height B, as well as a discrimination mark 101 in the form of a conical-shaped indent which is recessed at the center of the discharging surface 111F and has an opening width D and a depth D.

The composite chip 1F is produced as follows. First, the discrimination mark 101 is formed by indenting the sheet material for the discharging layer of the composite sheet material as in the sixth embodiment. Then, the composite chip 1F is punched out and, at the same time, the rounded corner is formed along the peripheral edge of the sheet material for the discharging layer.

The other construction is similar to that of the fifth embodiment.

With this embodiment, the advantages similar to those of the fifth embodiment can also be obtained.

The width of the rounded corner is preferably in the range of 0.05 to 0.4 mm. If the width is less than 0.05 mm, there is a fear that the rounded corner can not be surely discriminated. If the width is in excess of 0.4 mm, there is a fear that discharging properties of the composite chip or welding of the composite chip to the discharge portion may be impaired.

In the case where the indent is formed in one side of the composite chip where the rounded corner is formed, the indent is preferably formed in such a manner that the rounded corner can be discriminated.

Also, the height of the rounded corner is preferably in the range of 0.05 to 0.3 mm. If it is less than 0.05 mm, there is a fear that the rounded corner can not be surely discriminated. If it is in excess of 0.3 mm, there is a fear that discharging properties of the composite chip or welding of the composite chip to the discharge portion may be impeded.

The above-mentioned indent is formed at any desired position on one side surface of the composite chip. The indent may be in the form of a circular cone, a triangular pyramid, a quadrangular pyramid, a multi-cornered pyramid, or a single groove.

The opening width of the indent is preferably in the range of 0.1 to 0.6 mm. If it is less than 0.1 mm, there is a difficulty in discriminating the indent. If it is in excess of 0.6 mm, there is a fear that discharging properties of the composite chip or welding of the composite chip to the discharge portion may be impeded.

The depth of the indent is preferably not less than 0.02 mm, but not larger than ½ of the thickness of the discharging layer or the heat stress relieving layer in which the indent is formed. If it is less than 0.02 mm, there is a difficulty in discriminating the indent. If it is over ½ of the thickness of the discharging layer or the heat stress relieving layer in which the indent is formed, there is a fear that discharging properties of the composite chip or welding of the composite chip to the discharge portion may be impeded.

Figure 15:
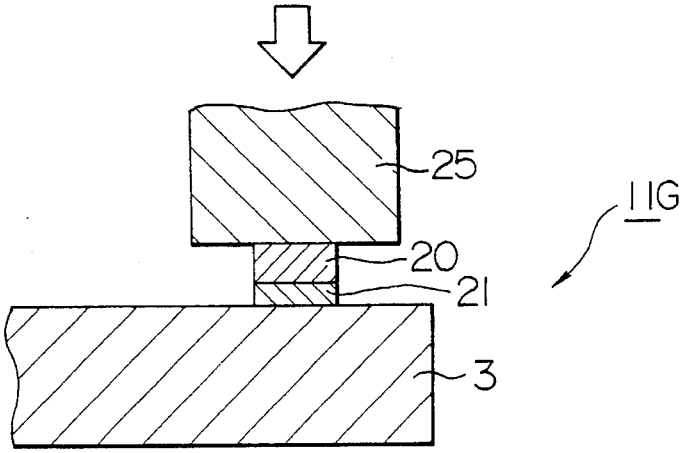
FIG. 15 is an explanatory view showing a manufacturing method according to a ninth embodiment of the present invention.

FIG. 15 shows a manufacturing method according to a ninth embodiment of the invention for use in joining a composite chip 11G to the ground electrode 3 by resistance welding.

First, the composite chip 11G is placed on the ground electrode 3 and pressed by a weld electrode rod 25 of a resistance welding machine under energization through energizing means (not shown). The composite chip 11G is joined to the ground electrode 3 with the Joule heat generated at the joint interface therebetween by the supplied weld current.

In that first energizing step as a first welding step, the composite chip 11G is welded under such conditions of resistance welding that the pressing force is 25 Kg, the energizing time is 10 cycles, and the energizing current is 800 A.

Thereafter, the composite chip 11G is welded again in a second energizing step as a second welding step by setting the energizing current to 1000 A.

Figure 16:
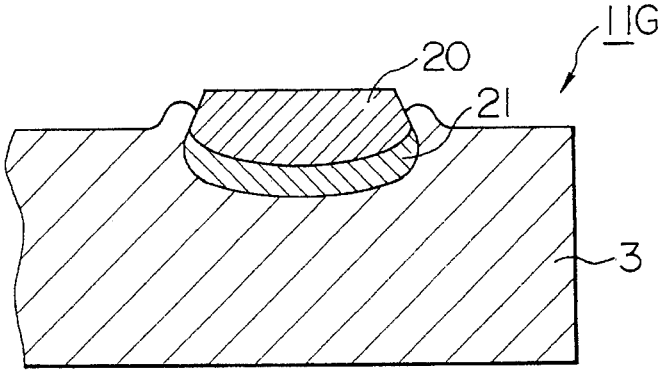
FIG. 16 is a sectional view of a composite chip after it has been attached to a spark plug according to the ninth embodiment of the present invention.

In the ninth embodiment, as described above, the composite chip 11G is welded by dividing the resistance welding process into two steps rather than directly applying a large current to the composite chip 11G at a time. As shown in FIG. 16, the composite chip 11G after the welding undergoes a thermal deformation due to the heat generated during the welding. However, the composite chip 11G can be joined in such a state that it is buried in the ground electrode 3 with a satisfactory strength of adhesion, without melting of a heat stress relieving layer 21, any burrs, and thinning or localizing of the layer thickness.

More specifically, since the welding is carried out in the first welding step on condition of the low current, the Joule heat generated at the joint interface is small and the heat stress relieving layer 21 is not melted. On the other hand, the first welding step makes it possible to achieve thermally and electrically positive welding at the joint interface after the welding.

Then, even if a large current is applied in the second welding step, the Joule heat generated at the joint interface is adequately transmitted to the ground electrode 3 and heating of the heat stress relieving layer 21 is suppressed, because the thermal and electrical joint is established between the heat stress relieving layer 21 and the ground electrode 3. Therefore, the ground electrode 3 is so softened that the composite chip 11G is buried to be jointed to the ground electrode 3.

The heat stress relieving layer 21 thus joined is advantageous in that its thickness after the welding can be secured enough to exhibit a heat stress relieving effect, and a sufficient degree of adhesion can be achieved at the joint interface. Additionally, because of being buried in the ground electrode 3, the heat stress relieving layer 21 is not directly exposed to the combustion gas and hence less oxidized.

By adopting the two-divided energizing or welding step of the ninth embodiment, even in the composite chip comprising the discharging layer and the heat stress relieving layer which are made of materials having different melting points from each other, it is possible to set the energizing condition suitable for supplying a large current and ensure high reliability at the joint interface.

Furthermore, detailed studies were made on the relationship between conditions of the first resistance welding and the second resistance welding.

Figure 17:
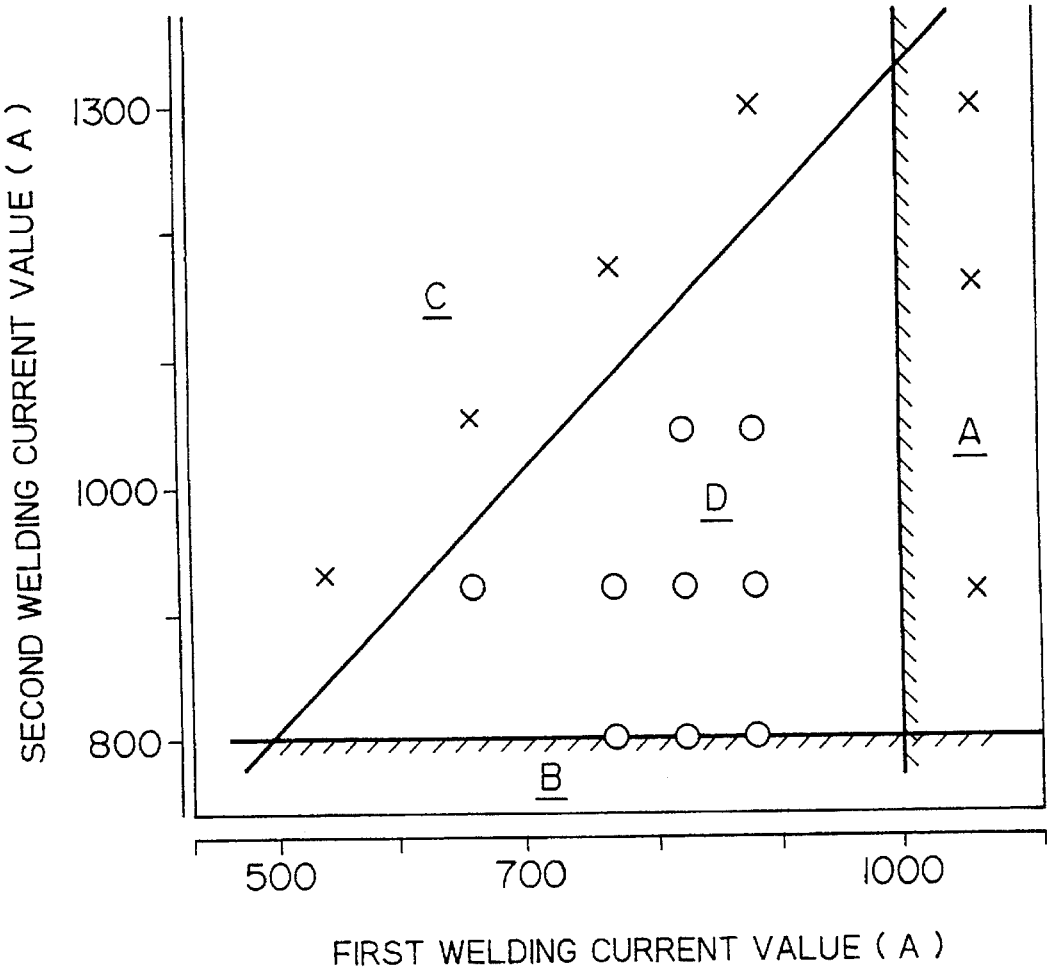
FIG. 17 is a characteristic graph showing the relationship between a first welding current value and a second welding current value in the ninth embodiment.

FIG. 17 is a characteristic graph showing the relationship between a first welding current value and a second welding current value. In the graph of FIG. 17, satisfactory results of the welding are indicated by marks o and unsatisfactory results of the welding are indicated by marks x.

The composite chip employed in this experiment was comprised of, like the ninth embodiment, a discharging layer which is made of an 80 wt % Pt–20 wt % Ir and has a thickness of 0.4 mm, and a heat stress relieving layer which is made of an 80 wt % Pt–20 wt % Ni and has a thickness of 0.2 mm.

Also, only the current values in the first and second resistance welding were changed under the same conditions that the pressing force is 30 Kg, the energizing cycles are 10, and the rising slope of the energizing current is 3.

As seen from FIG. 17, in the region A where the first welding current value is too high, there was produced a burr larger than 0.6 mm in the heat stress relieving layer during the first welding as in the prior art.

Also, in the region B where the second welding current value is too low, the composite chip cannot be joined to the ground electrode with a sufficient degree of joint strength.

Further, in the region C where the second welding current value is too high relative to the first welding current value, there was produced a burr larger than 0.6 mm in the heat stress relieving layer during the second welding.

Assuming that the first welding current value is X and the second welding current value is Y, the relationship between the first and second welding current values can be expressed as follows:

Region A in FIG. 17; $X>1000$ (A)

Region B in FIG. 17; $Y<800$ (A)

Region C in FIG. 17; $Y=X+300$ (A)

where (A) represents an ampere.

From the above studies, it is found that the optimum range for the first and second welding current values in the present invention is Region D surrounded by those Regions A, B and C.

It could be also confirmed that in the case of changing the pressing force, the result having a similar tendency to the above result was obtained.

While the above ninth embodiment has been described in connection with the second composite chip being joined to the ground electrode, there can be of course expected the advantages of prolonging a life of the spark plug and improving its reliability by making the first composite chip, which is to be joined to the distal end of the central electrode, subjected to the same two-divided welding step as mentioned above.

Further, the ninth embodiment has been described as carrying out the first energizing step to become the first welding and the second energizing step to become the second welding. It is however needless to say that the present invention is not limited thereto and the first and second energizing steps may be each performed in plural times.

According to the present invention, when the composite chip comprising the discharging layer and the heat stress relieving layer is joined to the electrode by resistance welding, the thermal and electrical contact between the electrode material and the composite chip is surely established by the first welding step. Therefore, even when the second welding step is performed under the energizing condition suitable for providing a sufficient degree of adhesion, heat generated during resistance welding is not concentrated on the heat stress relieving layer but is distributed between the heat stress relieving layer and the electrode in a well-balanced way, with the result that the heat stress relieving layer is not melted and the composite chip is buried in the ground electrode to be joined thereto in a satisfactory condition.

What is claimed is:

1. A spark plug comprising:

a central electrode;

a ground electrode; and a composite chip comprising a discharging layer and a heat street relieving layer, which layers are integrally joined beforehand, said heat stress relieving layer being joined to at least one of said central electrode and said ground electrode; and an alloy layer formed between said discharging layer and said heat stress relieving layer to be effective in joining said discharging layer and said heat stress relieving layer to each other, said alloy layer having a thickness of at least 3 μm or more, said discharging layer consisting of 70 to 100 wt. % of platinum and 0 to 30 wt. % of iridium, said heat stress relieving layer of said composite chip being provided on at least one of said first and second electrodes, and consisting of 60 to 90 wt. % of platinum and 10 to 40 wt. % of nickel, wherein irregularities are formed on a surface of said discharging layer only.

2. A spark plug according to claim 1, wherein said composite chip has a discrimination mark which is an arc-shaped corner formed along a peripheral edge of said discharging layer.

3. A spark plug according to claim 1, wherein said composite chip has a discrimination mark which is an indent formed in one surface of said discharging layer, said indent being formed in a composite sheet material from which said composite chip is to be formed.

4. A spark plug according to claim 1, wherein said alloy layer serves to accommodate heat stress generated between said discharging layer and said heat stress relieving layer.

5. A spark plug according to claim 1, wherein said composite chip is joined to said ground electrode.

6. A spark plug according to claim 5, further comprising a single spark- and wear-resistant discharging layer joined to said central electrode.

7. A spark plug comprising:

first and second electrodes opposing each other; and a composite chip comprising a discharging layer and a heat stress relieving layer, which layers are integrally joined beforehand, and an alloy layer formed between said discharging layer and said heat stress relieving layer to be effective in joining said discharging layer and said heat stress relieving layer to each other, said alloy layer having a thickness of at least 3 μm or more, said composite chip being provided on at least a one of said first and second electrodes with said heat stress relieving layer being in contact with said at least one of said first and second electrodes, said heat stress relieving layer consisting of 60 to 90 wt. % of platinum and 10 to 40 wt. % of nickel, said discharging layer having irregularities formed thereon being formed at a surface of said composite chip opposed to said at least one of said first and second electrodes and consisting of 70 to 100 wt. % of platinum and 0 to 30 wt. % of iridium, wherein said irregularities are formed on a surface of said discharging layer only.

8. A spark plug according to claim 7, wherein said composite chip is joined to said second electrode.

9. A spark plug according to claim 7, further comprising a single spark- and wear-resistant discharging layer joined to said first electrode.

* * * * *